US009015921B2

(12) United States Patent
Queval et al.

(10) Patent No.: US 9,015,921 B2
(45) Date of Patent: Apr. 28, 2015

(54) METAL PALLETS WITH POLYMER HORNS

(75) Inventors: Arthur Queval, Lutry (CH); Laurent Kaelin, Sonvilier (CH); Thomas Wyss, Grenchen (CH)

(73) Assignee: Nivarox-Far S.A., Le Locle (CH)

( * ) Notice: Subject to any disclaimer, the term of this patent is extended or adjusted under 35 U.S.C. 154(b) by 317 days.

(21) Appl. No.: 13/569,706

(22) Filed: Aug. 8, 2012

(65) Prior Publication Data

US 2013/0036599 A1 Feb. 14, 2013

(30) Foreign Application Priority Data

Aug. 12, 2011 (EP) ..... 11177438

(51) Int. Cl.
*G04B 15/14* (2006.01)
*G04B 15/06* (2006.01)

(52) U.S. Cl.
CPC ..... *G04B 15/14* (2013.01); *G04B 15/06* (2013.01)

(58) Field of Classification Search
CPC ..... A01K 63/04; B21J 15/28; B21J 15/285; B21J 15/32; G04B 15/06; G04B 15/08; G04B 15/14; G04B 13/022; C08L 25/18
USPC ..... 29/243.53, 527.1, 564.1, 741, 759, 809, 29/896.9; 74/1.5; 185/38; 216/52; 235/60 TK; 368/124, 125, 127; 968/102
See application file for complete search history.

(56) References Cited

U.S. PATENT DOCUMENTS

| | | | | |
|---|---|---|---|---|
| 2,663,139 | A * | 12/1953 | Fink | 368/132 |
| 3,077,728 | A | 2/1963 | Stamm | |
| 3,738,101 | A * | 6/1973 | Simon-Vermot | 368/125 |
| 3,845,616 | A * | 11/1974 | Jeanmairet et al. | 368/124 |
| 3,853,714 | A | 12/1974 | Shimada et al. | |
| 4,024,677 | A * | 5/1977 | Meister et al. | 368/156 |
| 7,229,208 | B2 * | 6/2007 | Verardo et al. | 368/175 |
| 8,540,418 | B2 * | 9/2013 | Richard et al. | 368/128 |
| 8,591,101 | B2 * | 11/2013 | Hiraoka et al. | 368/132 |
| 2007/0227893 | A1 | 10/2007 | Saucy | |
| 2011/0062112 | A1 | 3/2011 | Saucy | |
| 2011/0303546 | A1 | 12/2011 | Saucy | |

FOREIGN PATENT DOCUMENTS

| | | | |
|---|---|---|---|
| CH | 702 202 | A2 | 5/2011 |
| EP | 0 732 635 | A1 | 9/1996 |
| EP | 1 331 528 | A2 | 7/2003 |
| EP | 1 835 339 | A1 | 9/2007 |
| EP | 2 320 280 | A1 | 5/2011 |
| GB | 1 336 057 | | 11/1973 |
| JP | 2007-285716 | | 11/2007 |

OTHER PUBLICATIONS

European Search Report issued Feb. 10, 2012 in corresponding European Application No. 11 17 7438 filed on Aug. 12, 2011 (with an English Translation).

* cited by examiner

*Primary Examiner* — Alexander P Taousakis
*Assistant Examiner* — Lee A Holly
(74) *Attorney, Agent, or Firm* — Oblon, McClelland, Maier & Neustadt, L.L.P.

(57) ABSTRACT

A method for fabricating pallets for an escapement system concerns the field of escapement systems for timepieces. The method includes forming integrally, using a first material, a lever of pallets. A first end of the lever includes a dart. A second end of the lever includes two arms each for receiving a pallet stone. The method includes over-moulding a second material different from the first material on the first end of the lever in order to form a pallets fork. The method includes mounting the pallet stones and a staff to enable the pallets to be rotatably mounted.

24 Claims, 3 Drawing Sheets

METAL PALLETS WITH POLYMER HORNS

This application claims priority from European Patent Application No. 11177438.6 filed Aug. 12, 2011, the entire disclosure of which is incorporated herein by reference.

FIELD OF THE INVENTION

The invention relates to an escapement system for a timepiece and, more specifically, a system of this type comprising pallet fork wherein the function of the lever and that of the fork can be uncoupled.

BACKGROUND OF THE INVENTION

Free escapement systems of the Swiss lever type are difficult to improve since they are a compromise between the lowest possible inertia and the best possible tribology of the pallet-stones and fork. Thus, it is difficult to prevent sticking between the impulse pin and the horns of the fork whilst maintaining minimum inertia and even insensitivity to magnetic fields.

SUMMARY OF THE INVENTION

It is an object of the present invention to overcome all or part of the aforecited drawbacks by proposing a method for fabricating pallets having a low inertia lever and a fork with favourable tribological properties.

The invention therefore relates to a method for fabricating pallets for an escapement system, characterized in that it includes the following steps:

a) forming, using a first material, the lever of the pallets, a first end of which includes the dart and a second end includes two arms each for receiving a pallet stone;
b) over-moulding a second material on said first end so as to form a pallets fork;
c) adjusting said pallet stones and a staff to allow the pallets to be rotatably mounted.

According to a first alternative embodiment, the fabricating method according to the invention differs in that it includes the following steps:

a') forming, using a first material, the lever of the pallets, a first end of which includes the dart and a second includes two arms each forming an integral pallet stone;
b) over-moulding a second material on said first end so as to form a pallets fork;
c') mounting a staff to allow the pallets to be rotatably mounted.

According to a second alternative embodiment, the fabricating method according to the invention differs in that it includes the following steps:

a) forming, using a first material, the lever of the pallets, a first end of which includes the dart and a second end includes two arms each for receiving a pallet stone;
b') over-moulding a second material on said first end so as to form a pallets fork and on said second end in order to form said pallet stones;
c') mounting a staff to allow the pallets to be rotatably mounted.

Thus, advantageously according to the invention, the mechanical features provided by the lever material are no longer dependent on those of the fork. Consequently, by way of example, the lever may advantageously offer low inertia and the fork optimised tribology.

In accordance with other advantageous features of the invention:

Step a) or a') is achieved by a LIGA process, stamping or bar turning.

The first material is a metal or metal alloy.

The first material includes titanium, aluminium or an austenitic cobalt alloy.

Step b) or b') is achieved by injection into a mould formed using a LIGA process.

The second material is a polymer.

The second material includes polyoxymethylene.

The staff is formed of steel, brass or copper-nickel-zinc alloy.

Finally, the invention relates to a timepiece, characterized in that it includes an escapement system with pallets obtained from the method according to any of the preceding embodiments.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
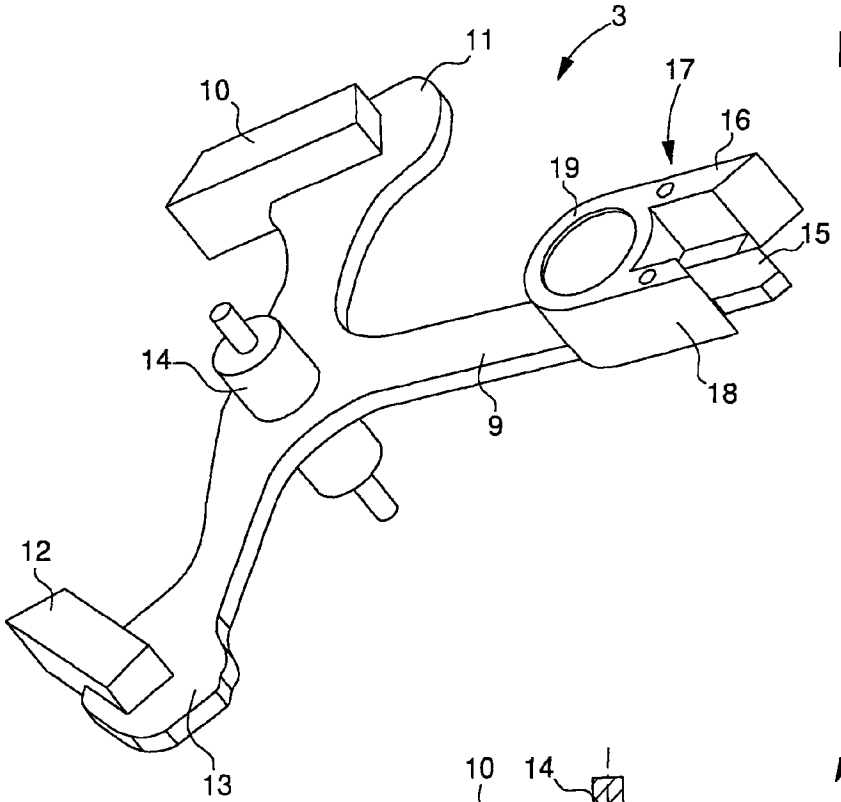
FIG. 1 is a diagram of pallets according to the invention.
Figure 2:
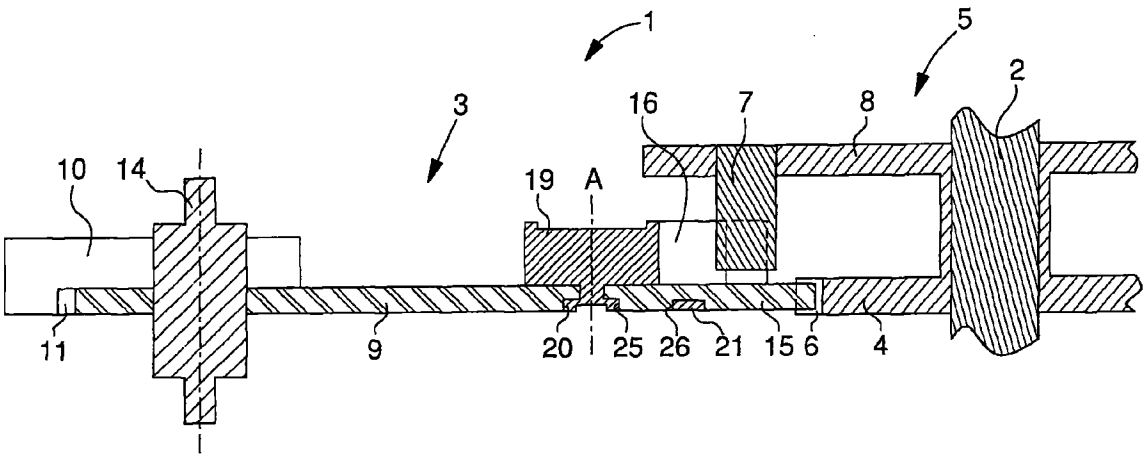
FIG. 2 is a partial cross-section of a timepiece including pallets according to the invention.

The examples illustrated in FIGS. 1 and 2 show an escapement system 1 for a timepiece. As seen in cross-section in FIG. 2, the escapement system 1 includes, in particular, pallets 3 for cooperating with a roller 5. Roller 5 is preferably driven onto the balance staff 2 and includes a small roller 4 provided with a notch 6 and a large roller 8 provided with an impulse pin 7.

Pallets 3 preferably include a lever 9 formed of a first metallic material which is preferably selected for its low density, low sensitivity to magnetic fields and possibly its capacity to change, for example, ruby pallet stones 10, 12.

Thus, preferably, the material of lever 9 may be, for example, titanium, aluminium or an austenitic cobalt alloy.

Lever 9 includes arms 11 and 13 for carrying pallet stones 10 and 12 in order to cooperate with at least one escape wheel (not shown), of escapement system 1. The pallet staff 14 is mounted between these two arms 11 and 13 for pivotably mounting pallets 3. Staff 14 may be made, for example, of a material like steel, brass or copper-nickel-zinc alloy. Finally, at the opposite end to arms 11 and 13, lever 9 has a dart 15 and a pallets fork 17.

Advantageously according to the invention, dart 15 is integral with lever 9 and preferably in the extension thereof. Dart 15 is for cooperating with the small roller 4 to prevent accidental movements of pallets fork 17.

pallet fork 17 preferably includes an over-moulding 19 formed by a second material which is preferably different from the first material of lever 9 and intended to improve the tribological properties of fork 17 on impulse pin 7 while avoiding adversely affecting the overall inertia of pallets 3. Preferably, the material of fork 17 is also paramagnetic in order to reduce the sensitivity of pallets 3 to magnetic fields.

The material of pallets fork 17 is ideally a material exhibiting low wear and having a low friction coefficient in association with impulse pin 7 of large roller 8. This material may be a polymer.

Preferably, the polymer used is polyoxymethylene (POM) for its particular shock damping properties, low sensitivity to magnetic fields and very good tribological properties. During development it was thus discovered that the hertz pressure exerted by the ruby impulse pin on the polyoxymethylene horns was limited to 54 Mpa, i.e. an 85% reduction in mechanical stresses compared to standard steel horns.

Fork 17 is preferably over-moulded onto lever 9 at dart 15 and includes two horns 16 and 18 intended to enter into contact with impulse pin 7 of large roller 8 in order, after the rotation of pin 7, to pivot pallets 3 about staff 14 in a to-and-fro motion.

Advantageously according to the invention, separating the materials of pallets fork 17 from that of lever 9, optimises the properties of pallets 3 between the desired sensitivity to magnetic fields and/or the desired inertia of lever 9 on the one hand, and on the other hand the low wear and low friction coefficient of pallets fork 17 in association with impulse pin 7.

Figure 4:
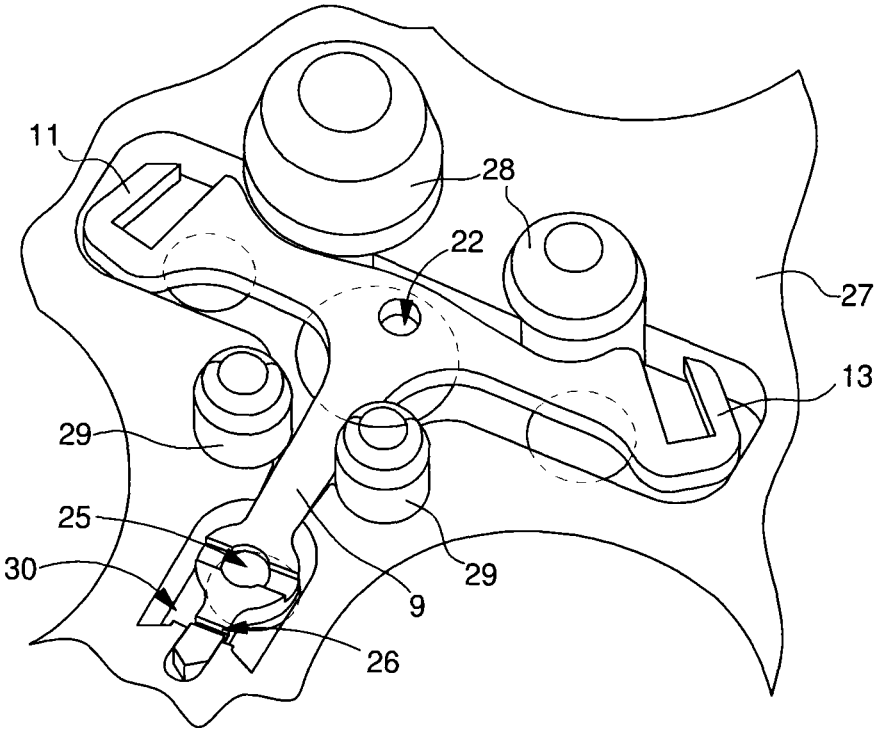
FIG. 4 is a diagram of an over-moulding step according to the invention.

Preferably, the over-mould of pallets fork 17 traps lever 9 so as to ensure that it does not become detached. Thus, as seen in FIGS. 2 and 4, lever 9 includes notches 25, 26 enabling the over-moulding to form bridges 20 and 21 of polymer material locking fork 17 against lever 9.

Of course, lever 9, pallet stones 10, 12 or staff 14 may be different. Thus, by way of example, according to a first alternative, pallet stones 10, 12 may be integral with lever 9 if one does not wish to be able to change pallet stones 10, 12. For the same purpose, according to a second alternative, pallet stones 10, 12 may be over-moulded in an identical or similar manner with respect to pallets fork 17. i.e. with a polymer such as, for example, polyoxymethylene.

Figure 5:
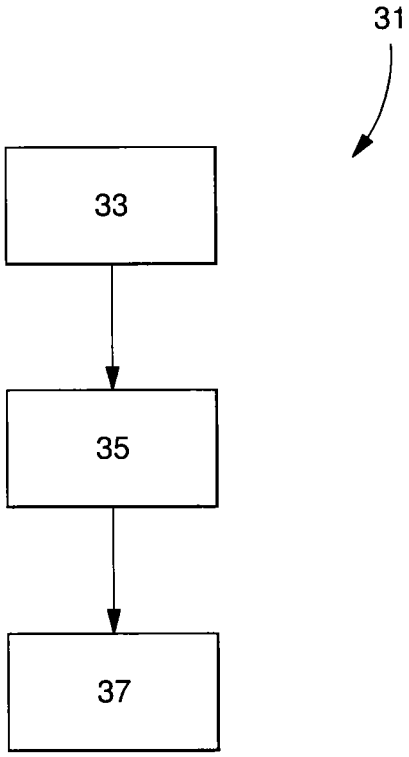
FIG. 5 is a block diagram of the method according to the invention.

The method 31 of fabricating pallets 3 will now be explained with reference to FIG. 5. Method 31 includes a first step 33 for forming, using a first material, the body of pallets 3, a first end of which includes dart 15 and a second end includes the two arms 11, 13 each for carrying one pallet stone 10, 12.

Figure 3:
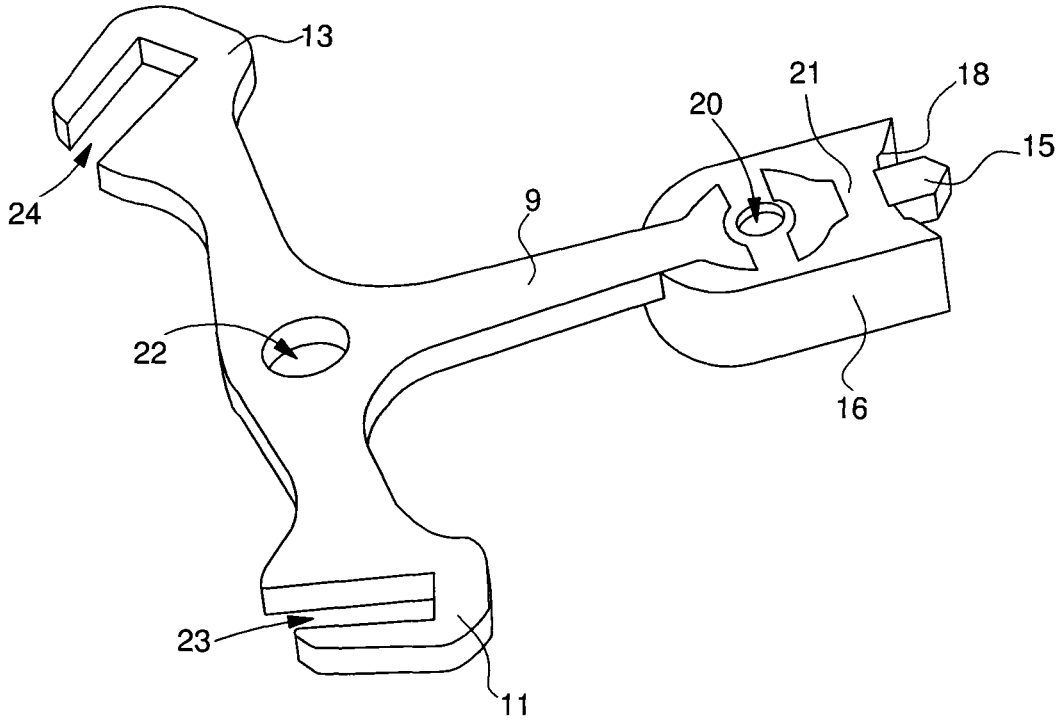
FIG. 3 is a diagram of unfinished pallets according to the invention.

Step 33 may be achieved by numerous techniques, such as for example a LIGA process, stamping or bar turning. This step 33 allows lever 9, arms 11, 13 and dart 15 to be fabricated in a single piece. As seen in FIG. 3, lever 9 has a hole 22 for fitting staff 14. Moreover, each arm 11, 13 has a hole 23, 24 for fitting a pallet stone 10, 12.

Of course, in the case of the first alternative cited above, step 33 is also for forming an integral pallet stone 10, 12 on each arm 11, 13.

Finally, as explained above, step 33 also preferably forms notches 25, 26 which will be filled with the future over-mould(s).

Method 31 continues with the second step 35 for over-moulding a second material on the first end, i.e. near dart 15, to form pallets fork 17 and, possibly, on said second end in order to form pallet stones 10, 12. Preferably, to guarantee optimum structural quality, the mould 27 used for over-moulding is achieved by a LIGA process, i.e. photolithography followed by galvanoplasty.

Mould 27 includes stop members 28 and 29 for locking arms 13, 11 and lever 9 respectively. Only cavity 30 of mould 27 is intended to be filled. Of course, several over-moulds could be made in the same mould 27, i.e. mould 27 could include several cavities 30 and several pallets levers could be placed in the mould and/or other parts of lever 9 could be over-moulded, for example to make the second alternative embodiment.

As explained above, the second material is preferably a polymer. Consequently, step 35 preferably consists in over-moulding the lever of the pallets by injecting polymer into cavity 30 of mould 27 in order to form the body of pallets fork 17 with, in particular, horns 16 and 18 and, possibly, according to the second alternative embodiment, to form pallet stones 10, 12 on arms 11, 13.

The third step 37 of method 31 is for mounting pallet stones 10, 12 in holes 23, 24 and staff 14 in hole 22 so that pallets 3 can be rotatably mounted. At the end of these last two steps, pallets 3 are finished and can be mounted in a timepiece as an element in a Swiss lever escapement system 1.

Of course, in the case of the first and second alternative embodiment, step 37 must be considered to be limited to mounting staff 14 in hole 22 so that pallets 3 can be rotatably mounted.

Consequently, pallets 3 are of the composite type, i.e. formed from two distinct materials. Thus, as shown in FIG. 2, the height of pallets 3, preferably on axis A, is entirely formed by the second material owing to notch 25 made in step 31 forming, in particular, an aperture in lever 9.

Of course, this invention is not limited to the illustrated example but is capable of various variants and alterations that will appear to those skilled in the art.

In particular the shapes of pallets 3 and/or roller 5 may be different. Pallets 3 may also include, for example, at least a third arm for carrying at least a third pallet stone for the application of the invention to a coaxial escapement system.

It is also possible to imagine adapting the shape of pallets fork 17 and more specifically that of horns 16 and 18 to fit another type of roller or another type of material of impulse pin 7 to prevent wear and sticking during successive contacts.

Finally, the different first and second materials may also be a difference in external coating, although the core of the materials is the same. By way of example, lever 9 could also be formed of polymer coated silicon without departing from the fact that the first material of lever 9 is different from the second material of fork 17.

What is claimed is:

1. A method for fabricating pallets for an escapement system, the method comprising:

a) forming integrally, using a first material, a lever of the pallets, a first end of the lever including a dart and a second end of the lever including two arms each for receiving a pallet stone;

b) over-moulding a second material different from the first material on said first end in order to form a pallets fork; and c) mounting said pallet stones and a staff to enable the pallets to be rotatably mounted.

2. A method for fabricating pallets for an escapement system, the method comprising:

a') forming integrally, using a first material, a lever of the pallets, a first end of the lever including a dart and a second end of the lever including two arms each forming an integral pallet stone;

b) over-moulding a second material different from the first material on said first end in order to form a pallets fork; and c') mounting a staff to enable the pallets to be rotatably mounted.

3. A method for fabricating pallets for an escapement system, the method comprising:

a) forming integrally, using a first material, a lever of the pallets, a first end of the lever including a dart and a second end of the lever including two arms each for receiving a pallet stone;

b') over-moulding a second material different from the first material on said first end so as to form a pallets fork and on said second end in order to form said pallet stones; and c') mounting a staff to enable the pallets to be rotatably mounted.

4. The method according to claim 1, wherein step a) is achieved by a LIGA process, stamping or bar turning.

5. The method according to claim 1, wherein the first material is a metal or metal alloy.

6. The method according to claim 5, wherein the first material includes titanium, aluminium or an austenitic cobalt alloy.

7. The method according to claim 1, wherein step b) is achieved by injection into a mould formed using a LIGA method.

8. The method according to claim 1, wherein the second material is a polymer.

9. The method according to claim 8, wherein the second material includes polyoxymethylene.

10. The method according to claim 1, wherein the staff is formed of steel, brass or copper-nickel-zinc alloy.

11. The method according to claim 2, wherein step a') is achieved by a LIGA process, stamping or bar turning.

12. The method according to claim 2, wherein the first material is a metal or metal alloy.

13. The method according to claim 12, wherein the first material includes titanium, aluminium or an austenitic cobalt alloy.

14. The method according to claim 2, wherein step b) is achieved by injection into a mould formed using a LIGA method.

15. The method according to claim 2, wherein the second material is a polymer.

16. The method according to claim 15, wherein the second material includes polyoxymethylene.

17. The method according to claim 2, wherein the staff is formed of steel, brass or copper-nickel-zinc alloy.

18. The method according to claim 3, wherein step a) is achieved by a LIGA process, stamping or bar turning.

19. The method according to claim 3, wherein the first material is a metal or metal alloy.

20. The method according to claim 19, wherein the first material includes titanium, aluminium or an austenitic cobalt alloy.

21. The method according to claim 3, wherein step b') is achieved by injection into a mould formed using a LIGA method.

22. The method according to claim 3, wherein the second material is a polymer.

23. The method according to claim 22, wherein the second material includes polyoxymethylene.

24. The method according to claim 3, wherein the staff is formed of steel, brass or copper-nickel-zinc alloy.

* * * * *